United States Patent [19]

Crews

[11] Patent Number: 4,857,886

[45] Date of Patent: Aug. 15, 1989

[54] TIMING SYSTEM

[76] Inventor: Eric J. Crews, 9 Sycamore St., Millbury, Mass. 01527

[21] Appl. No.: 161,005

[22] Filed: Feb. 26, 1988

[51] Int. Cl.[4] ..... G08B 23/00; G08B 1/12

[52] U.S. Cl. ..... 340/323 R; 340/941; 340/988

[58] Field of Search ..... 340/936, 941, 988, 992, 340/993, 323 R, 989; 273/86 R, 86 B; 342/44, 104; 364/410, 411, 424, 436, 460; 455/54, 56, 99

[56] References Cited

U.S. PATENT DOCUMENTS

| | | | |
|---|---|---|---|
| 3,714,649 | 1/1973 | Brouwer et al. | 340/989 |
| 3,946,312 | 3/1976 | Oswald et al. | 340/323 R |
| 4,074,117 | 2/1978 | DeLorean et al. | 340/323 R |
| 4,142,680 | 3/1979 | Oswald et al. | 340/323 R |
| 4,392,122 | 7/1983 | Hocken | 340/670 |

*Primary Examiner*—Joseph A. Orsino
*Assistant Examiner*—Brent A. Swaithout
*Attorney, Agent, or Firm*—Blodgett & Blodgett

[57] ABSTRACT

Timing system for use on a track involving a plurality of vehicles including a series of stationary transceivers located at selected locations along the track and a mobile transmitter located in each vehicle.

4 Claims, 2 Drawing Sheets

TIMING SYSTEM

BACKGROUND OF THE INVENTION

In the operation of a race track, it has been common practice to make timing records of the various vehicles as they pass through the finish line after each lap. It has also been recognized that making a timing record of a particular vehicle at various other portions of the track is helpful in many ways. In order to do this, in the past, it has been necessary to station a large number of personnel around the track to make a record of the time at the various stations. Not only is this expensive, but, when more than one vehicle is moving around the track, there is certainly difficulty in identifying the particular vehicle that is being timed. Automated systems using light beams and centralized timing have been in place in a few private test facilities, such as the Ferrari test track in Fiorano, Italy, but such sites are not available to the average racer. Furthermore, this arrangement is set up only for a single vehicle moving around the track at a given time. Such a system cannot be used, therefore, when a plurality of vehicles are present on the track, as would be true during preliminary testing of a motor vehicle. After all, in the test period before a race, it is not possible for a single racer and his vehicle to be alone on the track, because this would prevent other racers from testing their vehicles and the track itself. These and other difficulties experienced in the prior art devices have been obviated in a novel manner by the present invention.

It is, therefore, an outstanding object of the invention to provide a timing system for the timing of a vehicle at several points in a circuit when other vehicles are also present.

Another object of this invention is the provision of a timing system which is portable and is automated, so that the system, when deployed, will provide segment times to many competitors simultaneously.

A further object of the present invention is the provision of a timing system which combines existing radio frequency gear and micro-computers in an integrated system to monitor a car's progress over a race course in real time.

It is another object of the instant invention to provide a timing system which can be packaged in a trailer/motor home unit that can travel to numerous events and provide a timing service to any and all entrants before a race.

A still further object of the invention is the provision of a timing system which will not only give readouts on an individual vehicle's performance to a person carrying a mobile receiving unit in a remote location, but also can be transmitted to a mobile receiver in the given vehicle, while providing message capability from the vehicle's own pit to the vehicle.

It is a further object of the invention to provide a timing system which is simple in construction, which is inexpensive to manufacture, and which is capable of a long life of useful service with a minimum of maintenance.

It is a still further object of the present invention to provide a timing system which provides a racing competitor with sufficient data to help pinpoint operating habits that need improvement.

SUMMARY OF THE INVENTION

In general the invention consist of a timing system for use with a predetermined traffic course along with a plurality of vehicles, traveling in random sequence, the system consisting of a stationary transceiver located at selected locations along the course, each transceiver having a receiver portion with a short-range, narrow receiving pattern directed across the course and a transmitter portion with a relatively long-range, broad transmitting pattern. A mobile transmitter is located on each vehicle for transmitting a distinctive coded transmission of short time duration, the mobile transmitter having a short-range, broad pattern of transmission.

More specifically, a network controller is located in the vicinity of the course for receiving transmissions from the transmitting portion of each of the transceivers, whereby the controller receives all information of the time of arrival of each vehicle at each transceiver, irrespective of coincidental arrival of more than one vehicle at a given transceiver.

DESCRIPTION OF THE PREFERRED EMBODIMENT

Figure 1:
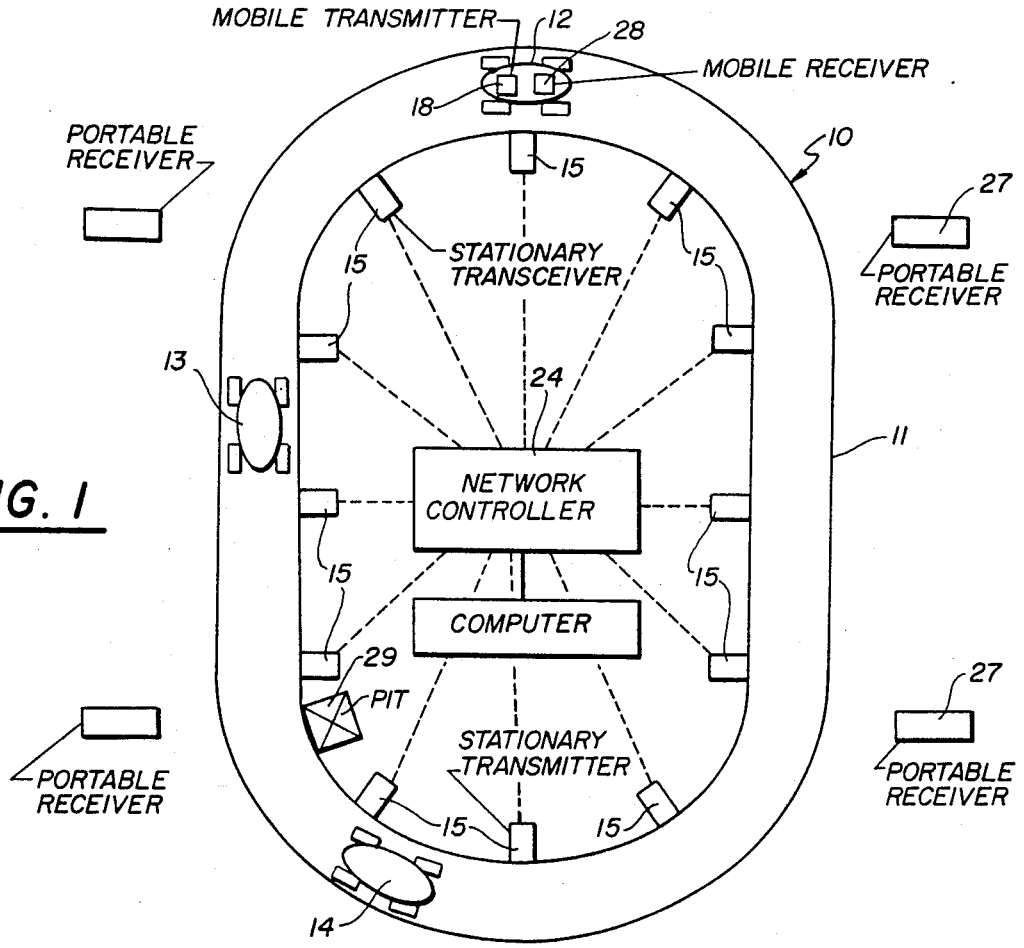
FIG. 1 is a plan view of a timing system incorporating the principles of the present invention shown in use with a race course.

Referring first to FIG. 1, which best shows the general features of the invention, it can be seen that the timing system, indicated generally by the reference numeral 10, is associated with a predetermined traffic course 11 whose preferred embodiment is an oval shaped race track. A plurality of vehicle's 12, 13, and 14, travel over the course in random sequence.

Figure 2:
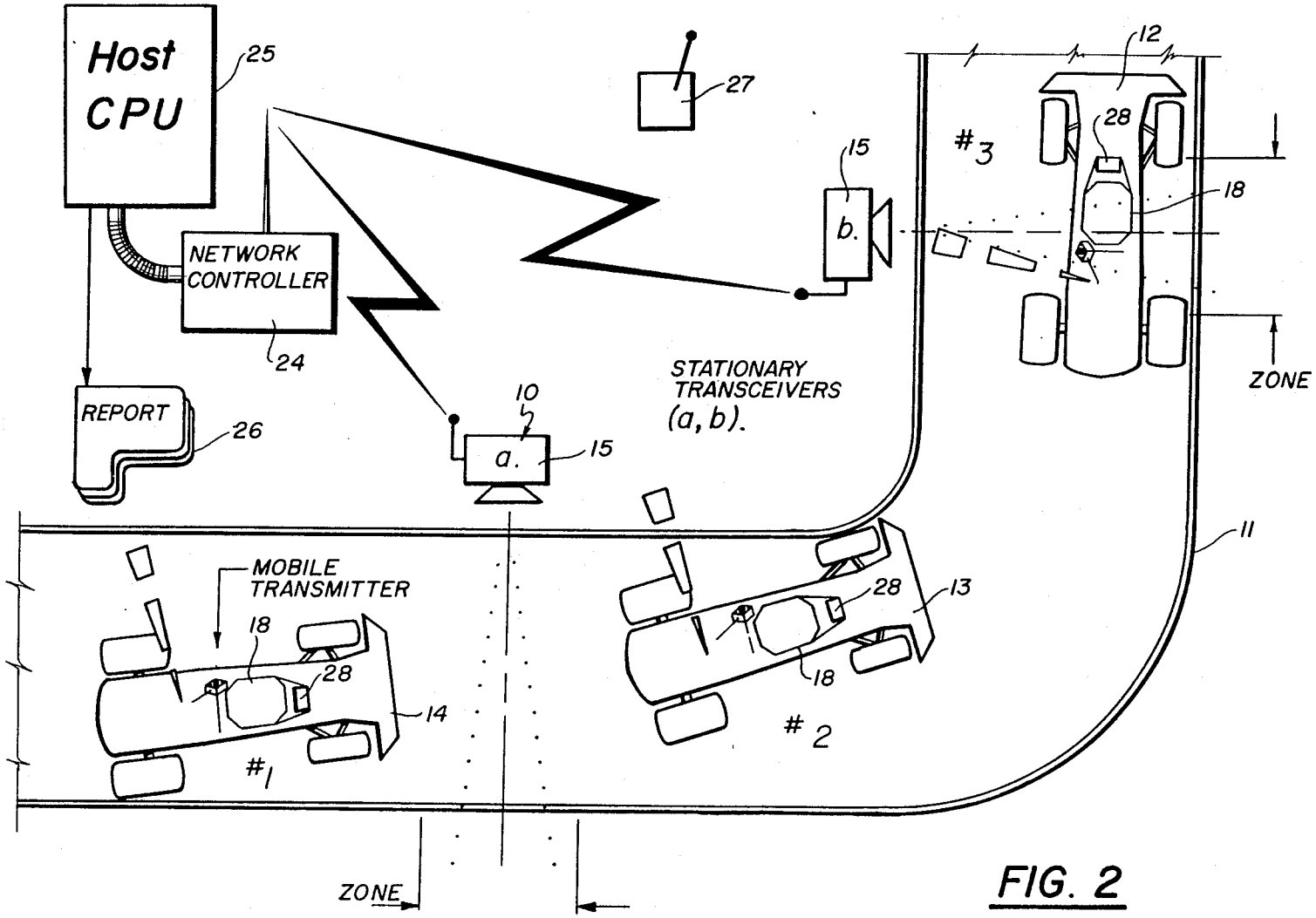
FIG. 2 is a plan view of a somewhat enlarged portion of the course showing several vehicles in motion.

As shown in FIG. 2, stationary transceivers 15 are located at a plurality of selected locations along the course 11 and a mobile transmitter 18 is mounted in each vehicle. A network controller 24 is located at a position remote from the transceivers and, in the preferred embodiment, would be located centrally of the course 11. The controller 24 is connected to a main computer 25 capable of generating hard copy of data developed within its circuitry to generate reports 26.

Figure 3:
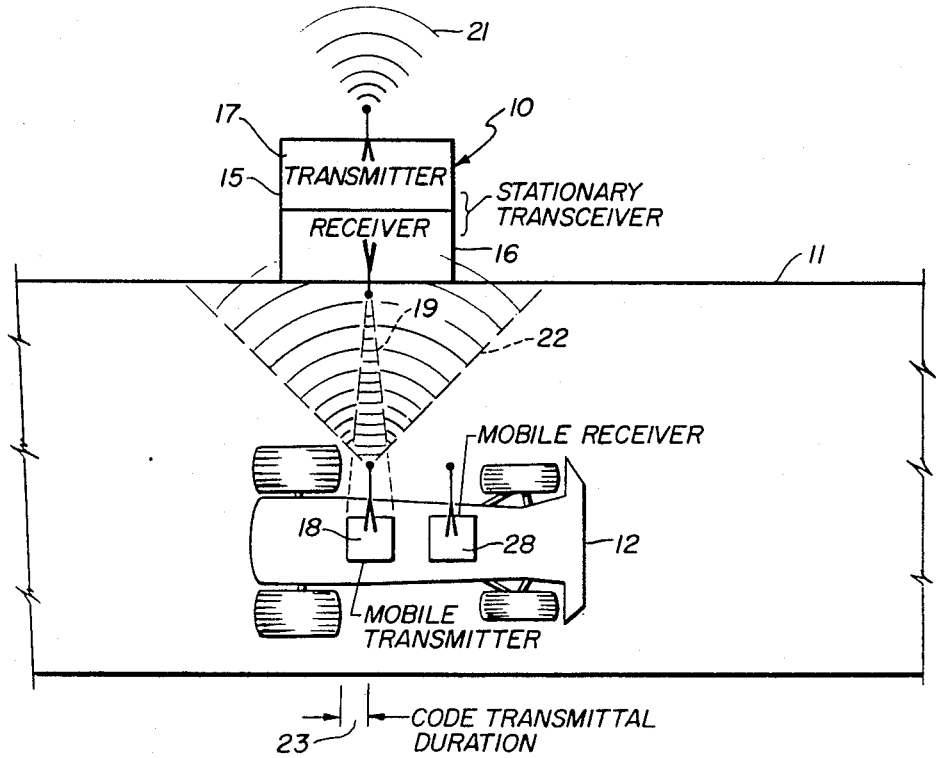
FIG. 3 is a still more enlarged section of the course showing one vehicle and an associated transceiver portion of the timing system.

Referring next to FIG. 3, it can be seen that each stationary transceiver 15 is provided with a receiver 16 which has a short range, narrow receiving pattern 19, directed across the course 11. The transceiver is also provided with a transmitter 17 having a sending pattern 21 which has a relatively long range, broad shape.

Each mobile transmitter 18 located in its vehicle has a transmitting pattern 22 that is short-range and broad in its transmission characteristics. The mobile transmitter sends a distinctive coded transmission of short time duration 23.

The network controller 24 receives transmissions from the transmitter of all the transcievers 15, whereby the controller receives all information of the time of arrival of each vehicle at each transceiver irrespective of coincidental arrival of more than one vehicle at a given transceiver.

The main computer 25 is adapted to receive information from the network controller 24 relative to all transceivers and all vehicles in order to generate reports on the operator of the individual vehicles.

In addition, a plurality of mobile receivers 27 are provided to receive coded information from the network controller. Each mobile receiver displays only information on a selected vehicle by virtue of the coding of the information.

At least one mobile receiver 28 is located in a vehicle having the same code designation as its specific coded information, whereby that vehicle receives only information relating to itself. The mobile receiver in the vehicle can also receive and display coded information from a pit transmitter 29 located in its own service pit.

In the preferred embodiment, the pit transmitter 29 transmits information that is coded to be displayed only by the mobile receiver in its own vehicle. This information would have to do with the information that would normally in the past be transmitted by the pit crew by means of signs, displayed to the vehicle as it passes.

The network controller 24 delivers starting time instructions to a clock in each of the stationary transceivers, so that they all contain the same time data. The receiver 16 associated with each transceiver stores data packets that include both vehicle code and the arrival time for each vehicle that passes the transceiver. The network controller can call upon the transmitter of each transceiver to provide it with the data from memory.

The operation and advantages of the invention will now be readily understood in view of the above description. Referring to FIG. 3, as the vehicle 12 passes along the course 11 it arrives opposite the transceiver 17. The mobile transmitter 18 on the vehicle transmits a short-range, fairly wide pattern 22 of signal, the signal containing its distinctive code. The code transmittal takes place during very short periods of time separated by fairly large intervals. The mobile transmitter 18 uses randomizing of its wait time between sends to further reduce the probability of over-writing another mobile transmitter's data. The basic formula for this would be (wait time+send time)=or greater than 1/1000th of a second. When this is combined with the narrow pattern 19 of the receiver 16 in the transceiver, the result is a very accurate indication of the time of arrival of the vehicle 12 opposite the transceiver. Naturally, the duration of each coded pulse must be such that the entire code transmission can take place during the interval that the mobile transmitter antenna resides in the pattern 19 of the transceiver. The accuracy in the preferred embodiment is in the order of 1/1000 of a second. Receiver 16 receives the code and then records not only the code but the time of the arrival of the vehicle with that code opposite its position. It can be understood that the possibility of two vehicles being in that position at the same time is almost inconceivable and this fact, combined with the fact that the information from the vehicle 12 is coded, indicates that there is no possibility of a transceiver storing a garbled packet of data. Occasionally, the network controller 24 will ask the receivers 16 of all the transceivers 15 to transmit information to it, which transmission may be done sequentially. In any case, the information of vehicle codes and associated times from the various transceivers is received by the network controller and transmitted to the main computer 25 where reports 26 are generated. At the same time, the information on a particular vehicle can be transmitted by the transmitter 17.

In the preferred embodiment the mobile transmitter 18 which is carried in the vehicle, is a pocket-sized, battery powered, high frequency transmitter. The unit is mounted inside the vehicle and, when activated, emits a unique identifying code over a fixed frequency. The low power of the unit limits the range of the signal to 100 or 200 feet. This is usually sufficient to limit the transmittal to a single transceiver 15. The stationary transceivers 15 are battery-powered, high frequency, dual channel receiver/transmitters that have highly accurate timers. The units are placed at points around the circuit, so that major features (such as turns and straightaways) are delineated. The units have a high directivity on the channel that receives the mobile transmitter and are low powered. This combination permits the stationary transceiver to receive signals only from the mobile transmitter that is within its zone. The internal timer on each stationary transmitter 15 is initialized by a signal given by the network controller 24. Once started, a stationary transceiver will build data packets for all mobile transmitters that pass by. The data contains the unique identifying code of each mobile transmitter that passes by plus the time that they passed within 1/1000 of a second. The data is stored until a signal to transmit is given specifically to it by the network controller.

The network controller 24 is a high frequency intelligent transceiver that is connected to the main computer 35. By means of specialized software on the main computer this unit controls the collection of data packets form the various remote stationary transceivers. These data packets are marked with the identifier of the stationary transceiver that transmitted them, and then they are fed to the host computer. The main or host computer then performs error checks and other standard data manipulations in order to present the data to an individual competitor in hard copy form as a report 26. The only data a given customer receives is his own segment and full lap times in a formatted report. This report can be distributed to a wireless hand-held printer device associated with the portable receivers 27 that the customer will be issued along with his mobile transmitter or the customer can pick up the report at the service center where the main computer 25 is located.

One of the interesting features of the system is that the use of the portable receiver 27 (either remote from the vehicle or in the vehicle itself) allows the customer to receive segment timing in a timing report in a near real-time mode. This is an improvement over waiting until a complete lapping session or race is finished and then obtaining the complete report from the centrally located printer at the main computer 25. The information received, such as the position in the race, number of the laps to go, length of lead over competitors, and so forth, can be displayed in a clear view for the driver of the vehicle by the use of a flat liquid crystal display panel which is associated with the portable receiver in the vehicle. Also, a message field in the panel allows messages from the pit crew to be sent to the driver, this is an improvement over the old pit-board method of communication between a pit crew and its driver that is still used at the present time. Officials can also utilize this vehicle display to augment the current manual method of signaling the competitors of a race with colored flags by providing the mobile receivers 28 with a terminal connection to the main computer 25. Officials could control the use and adherence to a yellow flag (no passing area), black flags (return to your pit), red flags (stop race), and so forth.

The in-car display can be used to display flag status to the competitor. By providing flag/race officials with access to a program in the host computer, they can monitor the competitor's compliance with signal flags. They can also direct specific flag indicators on the in-car display to turn on/off.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to be secured by Letters Patent is:

1. Timing system for use with a predetermined traffic course along which a plurality of vehicles travel in random sequence, comprising:

(a) stationary transceiver located at each of several selected locations along the course, each transceiver having a receiver portion with a short range, narrow receiving pattern directed across the course and a transmitter portion with a relatively long range, broad transmitting pattern, wherein the receiver portion associated with each transceiver stores data packets in a memory that include both vehicle code and arrival time for all vehicles that pass the transceiver, (b) a mobile transmitter located on each vehicle and transmitting a distinctive coded transmission of short time duration, the transmitter having a short range, broad pattern of transmission, and (c) a network controller located in the vicinity of the course for receiving transmissions from the transmitter portion of all the transceivers, whereby the controller receives all information of the time of arrival of each vehicle at each transceiver, irrespective of coincidental arrival of more than one vehicle at a given transceiver, wherein a main computer is provided to receive information from the network controller relative to all transceivers and all vehicles to generate reports on the individual vehicles, wherein said computer includes means for directing the network controller to cause the transmitter of each respective transceiver to transmit the data packets from each memory to the network controller, wherein a plurality of mobile receivers are provided to receive coded information from the network controller, each mobile receiver displaying only information on a selected vehicle by virtue of the coding of the information, and wherein at least one mobile receiver is located in a vehicle which receives coded information pertaining only to that vehicle.

2. Timing system as recited in claim 1 wherein the mobile receiver with a display means in the vehicle can receive coded information from a transmitter located in its own service pit and show it on the display means.

3. Timing system as recited in claim 2, wherein the pit transmitter transmits information that is coded to be displayed only by the receiver in its own vehicle.

4. Timing system as recited in claim 3, wherein the receiver portion associated with each transceiver stores data packets in a memory that include both vehicle code and arrival time for all vehicles that pass the transceiver.

* * * * *